US005548314A

United States Patent [19]

Okazawa et al.

[11] Patent Number: 5,548,314

[45] Date of Patent: Aug. 20, 1996

[54] INK JET RECORDING HEAD

[75] Inventors: Noriaki Okazawa; Takahiro Naka; Shinji Yasukawa, all of Nagano, Japan

[73] Assignee: Seiko Epson Corporation, Tokyo, Japan

[21] Appl. No.: 241,974

[22] Filed: May 12, 1994

[30] Foreign Application Priority Data

May 12, 1993 [JP] Japan ..... 5-110342
May 12, 1993 [JP] Japan ..... 5-110343
May 9, 1994 [JP] Japan ..... 6-120579

[51] Int. Cl.[6] ..... B41J 20/45

[52] U.S. Cl. ..... 347/71

[58] Field of Search ..... 347/68, 70, 71, 347/72, 94; B41J 2/045, 2/055

[56] References Cited

FOREIGN PATENT DOCUMENTS 443628 8/1991 European Pat. Off. ..... B41J 2/45
5-84907 4/1993 Japan ..... B41J 2/45
6-71877 3/1994 Japan ..... B41J 2/45

*Primary Examiner*—Benjamin R. Fuller
*Assistant Examiner*—Alrick Bobb
*Attorney, Agent, or Firm*—Sughrue, Mion, Zinn, Macpeak & Seas

[57] ABSTRACT

An ink jet recording head for ejecting ink drops by expanding or shrinking a pressure generation chamber of an ink flow route forming member consisting of nozzle openings, the pressure generation chamber, an ink supply port, and a reservoir. Piezoelectric vibrators are disposed and fixed in a row with a predetermined pitch, to a piezoelectric vibrator support plate having excellent cutting properties and the piezoelectric vibrator support plate is fixed to a base made of material having a larger rigidity than the support plate. If the piezoelectric vibrator support plate receives reaction forces when ink is ejected, the base having a larger rigidity than the support plate resists the reaction force and suppresses undesired displacement of the contiguous piezoelectric vibrators.

16 Claims, 11 Drawing Sheets

INK JET RECORDING HEAD

BACKGROUND OF THE INVENTION

1. Field of the Invention

This invention relates to an ink jet recording head where piezoelectric vibrators expand or shrink a pressure generation chamber to generate ink drops, and more particularly to a structure of a piezoelectric vibrator unit of such an ink jet recording head.

2. Description of the Related Art

An ink jet recording head using piezoelectric vibrators having a nozzle plate formed with nozzle openings, a spacer for separating a pressure generation chamber, an ink supply port, a reservoir, and a vibration plate deformed by the piezoelectric vibrators to expand or shrink the pressure generation chamber is well known. The piezoelectric vibrators are oscillated based on a print signal to shrink or expand the pressure generation chamber, and thereby suck ink into the pressure generation chamber and eject ink drops therefrom consecutively.

In such an ink jet recording head, the area where piezoelectric vibrators abut a vibration plate can be made extremely small by using piezoelectric vibrators in a vertical vibration mode formed by laminating electrode material and piezoelectric material. With such a construction, a recording head having a resolution of 180 dpi or more can be provided.

A piezoelectric vibrator unit having piezoelectric vibrators each being, for example, 5 mm long, 70 μm wide, and 0.5 mm thick disposed on a piezoelectric vibrator support plate with a 0.14-mm pitch is used in such a high resolution recording head. To manufacture the piezoelectric vibrator units, a piezoelectric vibration plate formed by laminating alternate layers of piezoelectric material and electrode material and sintering them is formed with electrodes on one surface and cut like strips with a dicing saw, a wire saw, or the like with a predetermined pitch, such as 0.14 mm, with one end of the electrode face fixed to a base in a cantilever fashion.

Since the electrodes formed on the base must be separated for each piezoelectric vibrator the cut depth must extend at least to the piezoelectric vibrator support plate. Thus, material having excellent cutting properties, such as glass or piezoelectric material, is used for the piezoelectric vibrator support plate to avoid added resistance to cutting when the piezoelectric vibration plate is cut, thereby preventing the piezoelectric vibrators from being broken imperfectly formed.

According to this method, cutter vibration and shock can be prevented and the manufacturing yield of the vibrator units can be improved. On the other hand, materials having excellent cutting properties are low in rigidity. Thus when such devices receive a reaction force of the piezoelectric vibrators to which a drive signal is applied for jetting ink drops, they are easily distorted and the piezoelectric vibrators located nearby are displaced axially, causing ink mist ejection, i.e. undesired ink ejection, or crosstalk to occur.

SUMMARY OF THE INVENTION

It is therefore an object of the invention to provide an ink jet recording head capable of securely preventing crosstalk and ink mist from occurring without hindering a cutting operation for turning a piezoelectric vibration plate into a plurality of piezoelectric vibrators.

Accordingly, there is provided an ink jet recording head for ejecting ink drops by expanding or shrinking a pressure generation chamber of an ink flow route forming member consisting of nozzle openings, the pressure generation chamber, an ink supply port, and a reservoir. The piezoelectric vibrators are disposed and fixed in a row with a predetermined pitch to a piezoelectric vibrator support plate having an excellent cutting properties and the piezoelectric vibrator support plate is fixed to a base made of material having a rigidity which is larger than the support plate.

During a manufacturing process, the cut depth of a cutter is held within the range of material having excellent cutting properties and if the piezoelectric vibrator support plate is subjected to a reaction force when ink is ejected, the base absorbs the reaction force for suppressing displacement of the contiguous piezoelectric vibrators.

DETAILED DESCRIPTION OF THE PREFERRED EMBODIMENTS

Figure 1:
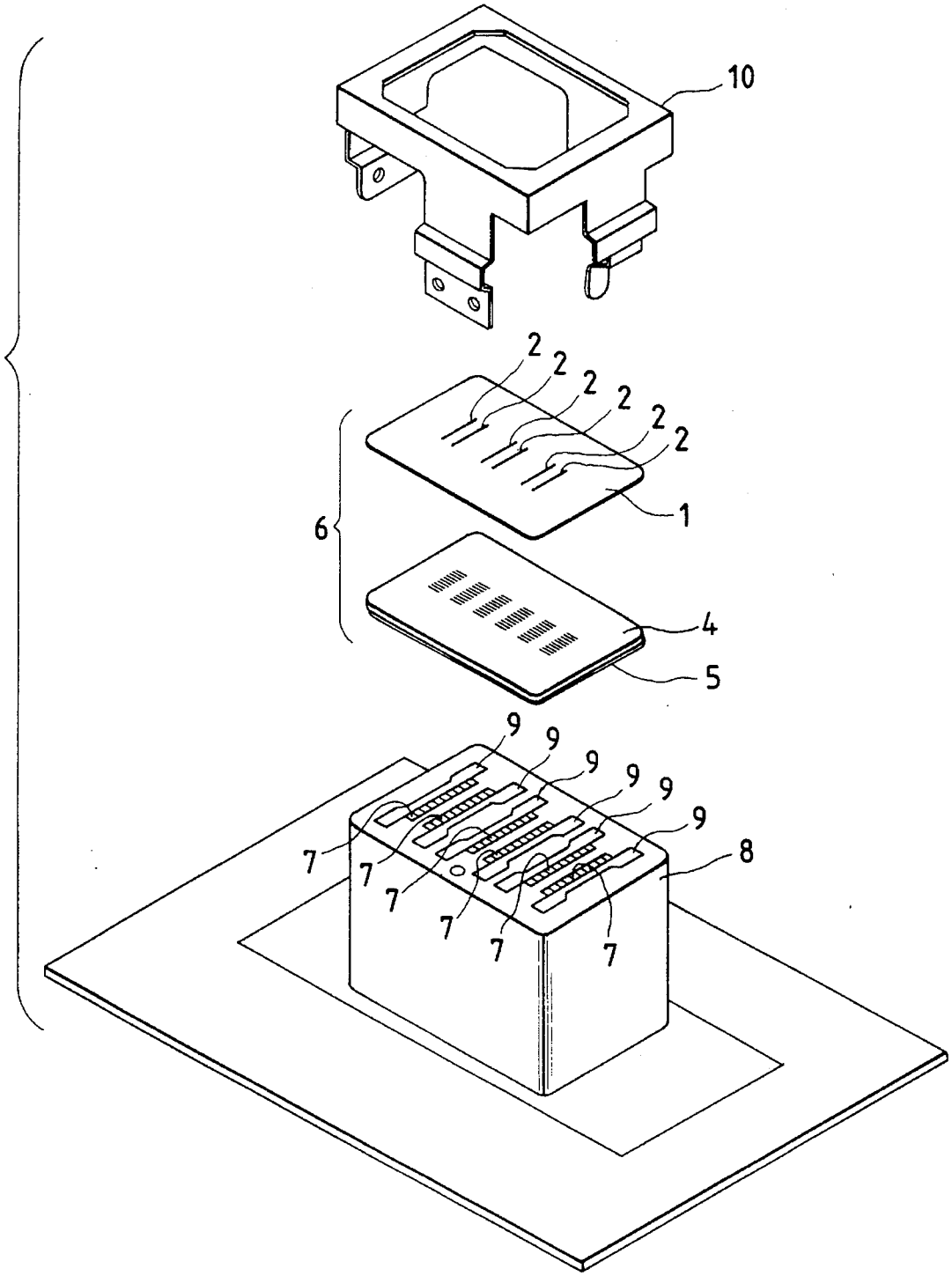
FIG. 1 illustrates an ink jet recording head utilizing the first preferred embodiment.

FIG. 1 illustrates one embodiment of an ink jet recording head according to the invention, wherein nozzle plate 1 has nozzle openings 2 pierced therein with a predetermined pitch so as to provide 180 dpi resolution, for example.

Spacer 4 is sandwiched between the nozzle plate 1 and a vibration plate 5 and formed with holes to define a pressure generation chamber, a reservoir, and an ink supply port connecting them so that the holes are communicated with the nozzle openings 1. The spacer 4, the nozzle plate 1, and the vibration plate 5 are bonded and integrated into an ink flow route forming member 6.

Piezoelectric vibrator units 7 are inserted into vibrator unit housing hole 9 of an outer case 8 so that free ends of the piezoelectric vibrator units abut the vibration plate 5 of the ink flow route forming member. All these components are unified by a frame 10 to constitute an ink jet recording head.

Figure 2:
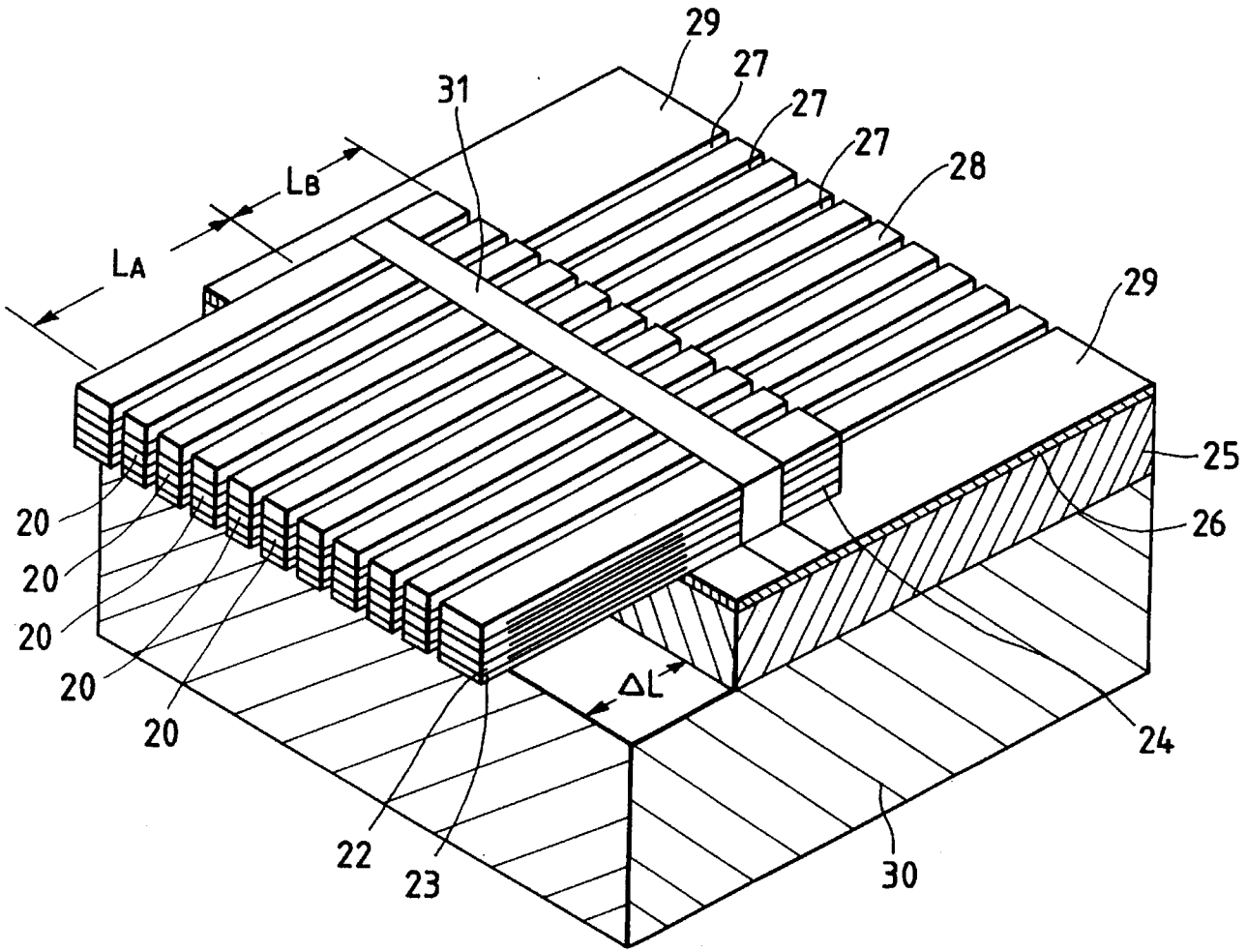
FIG. 2 illustrates the vibrator unit of the first preferred embodiment.

FIG. 2 illustrates the piezoelectric vibrator unit 7 of this embodiment. Piezoelectric vibrators 20 each formed by laminating alternate layers of piezoelectric material layers 22 and electrode layers 23, 24 and having an active area LA whose tip side only is expanded or shrunk, i.e., oscillated, and an inactive area LB which does not contribute to vibration.

The inactive areas LB of the piezoelectric vibrators 20 are fixed with an adhesive to a thin film electrode layer 26 formed on the surface of a vibrator support plate 25. The vibrator support plate 25 has slits 27 formed therein through the electrode layer 26 to the vibrator support plate 25 with the same pitch as the piezoelectric vibrators 20, when the piezoelectric vibration plate is cut for dividing the electrode layer 26 into drive electrodes 28, and common electrodes 29.

Numeral 30 is a base fixed to the other surface of the vibrator support plate 25 with an adhesive. The length of the base 30 is selected so that the tip side of the vibrators 20 project therefrom by a length ΔL. Numeral 31 is a common electrode junction member which is connected to electrodes formed on the surface of the piezoelectric vibrators 20 and has ends connected to the common electrodes 29 of the vibrator support plate 25. By adopting such an electrode structure, when a drive signal is applied to the common electrode 29 and the drive electrodes 28 only selected piezoelectric vibrators are oscillated for shrinking or expanding the pressure generation chamber.

Figure 3A:
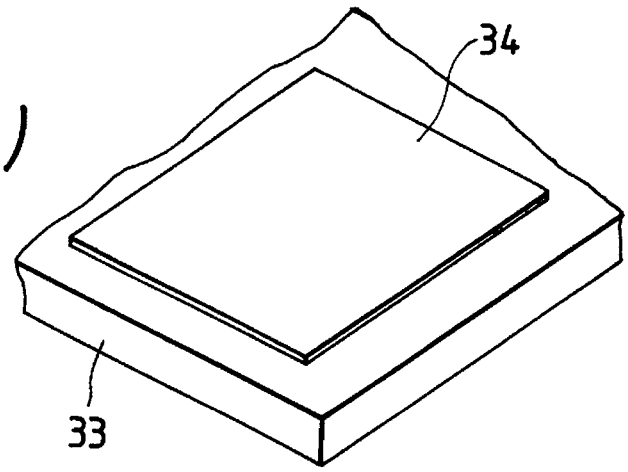
FIGS. 3(*a*)–3(*c*) illustrate the assembly process of the first preferred embodiment.
Figure 3B:
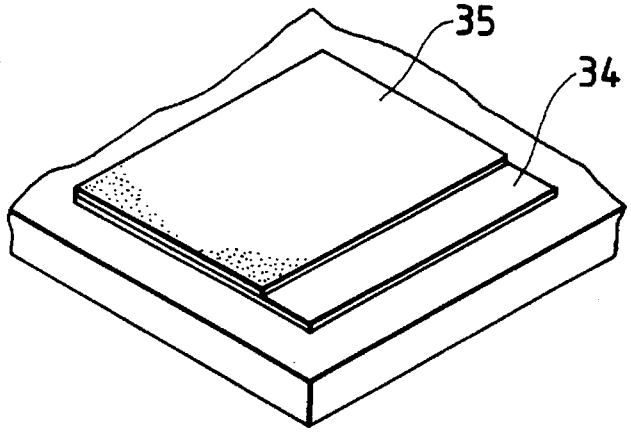
Figure 3C:
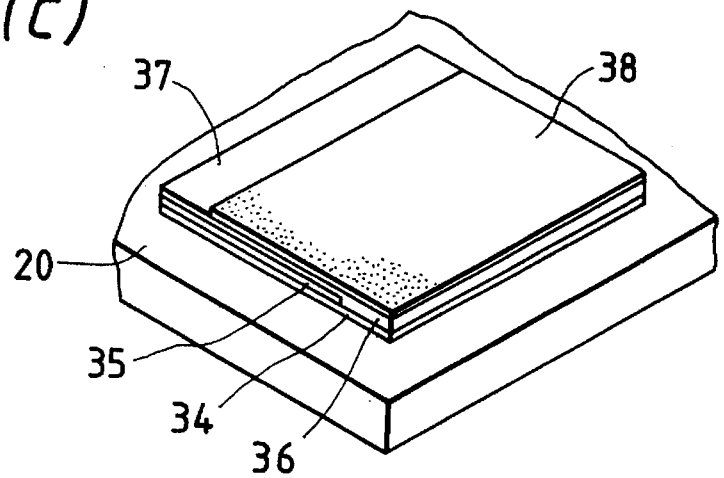
Figure 4A:
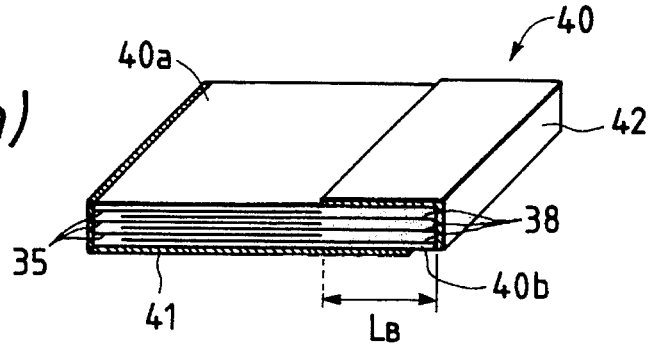
FIGS. 4(*a*)–4(*e*) illustrate the assembly process of the first preferred embodiment.
Figure 4B:
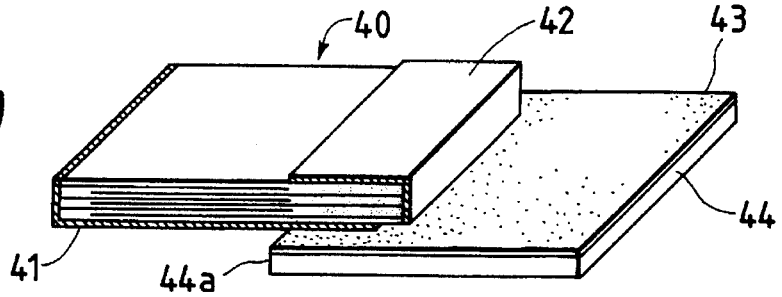
Figure 4C:
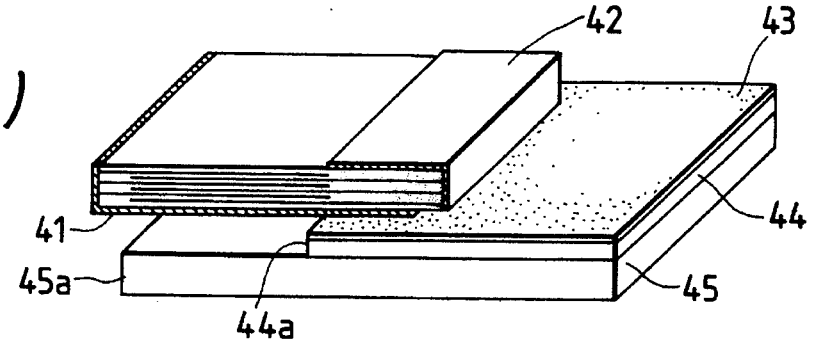
Figure 4D:
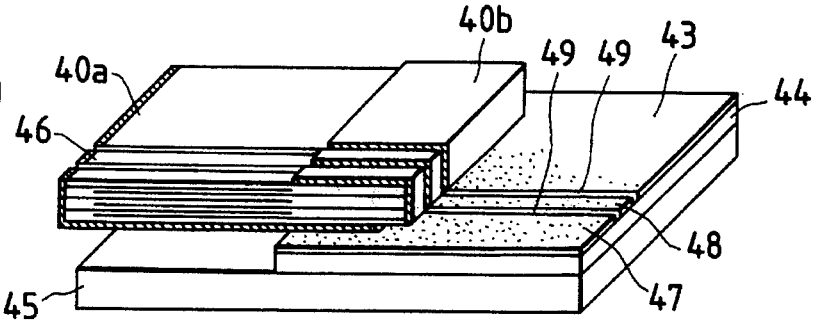
Figure 4E:
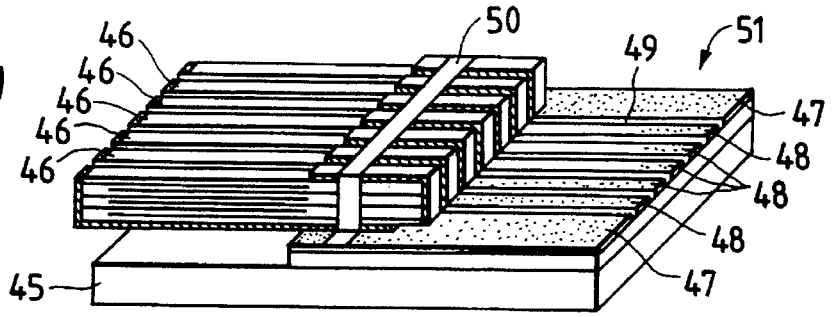

FIGS. 3(*a*)–(*c*) illustrates a manufacturing method of the piezoelectric vibration plate. A so-called "green sheet" 34 formed by fixing a clay-like piezoelectric vibration material on the surface of a substrate 33 as shown in FIG. 3(*a*) and an electrode layer 35 used as one pole is formed on the surface of the green sheet 34 as shown in FIG. 3(b).

Next, a green sheet 37 is laminated so as to fill in the level difference between the electrode layer 35 and the green sheet 34 and an electrode layer 38 used as the other pole is formed on the surface of the green sheet 37, as shown in FIG. 3(*c*). These steps are repeated until the desired number of layers are formed. After the green sheets 34 and 37 are dried to a predetermined degree, they are sintered while pressure is applied thereto, thereby providing a piezoelectric vibration plate having a predetermined thickness and a predetermined number of layers.

An electrode layer 41 is formed on a front end face 40*a* and the back of a piezoelectric vibration plate 40 thus provided and electrode layers 35 are connected in parallel. An electrode layer 42 is formed on a rear end face 40*b* and portion which becomes an inactive area LB on the surface and the electrodes 38 of piezoelectric vibrator 40 are electrically connected in parallel, as shown in FIG. 4(*a*).

The electrode layer 41 which will be cut into drive electrodes is fixed to a vibrator support board 44, made of a material having excellent cutting properties, such as piezoelectric material, glass, or the like similar to the material of piezoelectric vibrators, having an electrode layer 43 on the surface with a conductive adhesive, as shown in FIG. 4(*b*). A base 45 made of a material which is higher in rigidity than the piezoelectric vibrator support plate 44, such as carbon jig steel, stainless steel, soft iron, or zinc diecast material, having a front end 45*a* projecting toward the front end face 40*a* of the piezoelectric vibrator 40 to a greater degree than the front end 44*a* of the piezoelectric vibrator support plate 44, is fixed to the other surface of the vibrator support plate 44 with an adhesive, as shown in FIG. 4(*c*).

In this state, the base 45 is mounted on the bed of a cutting device such as dicing saw or wire saw and cutting is started with a predetermined pitch, for example, 140 μm from the front end face 40*a* to rear end face 40*b* of the piezoelectric vibration plate 40. When the cut area proceeds to the vibration support plate 44 at the cutting step, the cutter contacts the support plate 44. However, since the vibrator support plate 44 is made of a material having excellent cutting properties, i.e. cutting resistance similar to that of the piezoelectric material, the cutter continues the cutting operation in substantially the same load state as when cutting the piezoelectric vibration plate 40 only. Thus, after cutting of the piezoelectric vibration plate 40 terminates, the cutting is further continued to the other end of the piezoelectric vibrator support plate 44 at the same height. Thus, the piezoelectric vibration plate 40 is cut into piezoelectric vibrators 46 of predetermined size and the electrode layer 43 is separated into common electrodes 47 and drive electrodes 48 by slits 49, as shown in FIG. 4(*d*).

When such a cutting is repeated a predetermined number of times by sliding the cutter or the base 45 with a predetermined pitch, the piezoelectric vibration plate 40 is separated into the desired number of piezoelectric vibrators 46 and the electrode layer 43 is separated by slits 49 corresponding to the piezoelectric vibrators 46. The surface of the electrode layer 42 is connected by a common electrode conjunction member 50 and both ends are fixed to the common electrodes 47 of piezoelectric vibrator support plate 44 while their conductive relationship is maintained, thereby providing a vibrator unit 51 fixed to the base 45.

Figure 5:
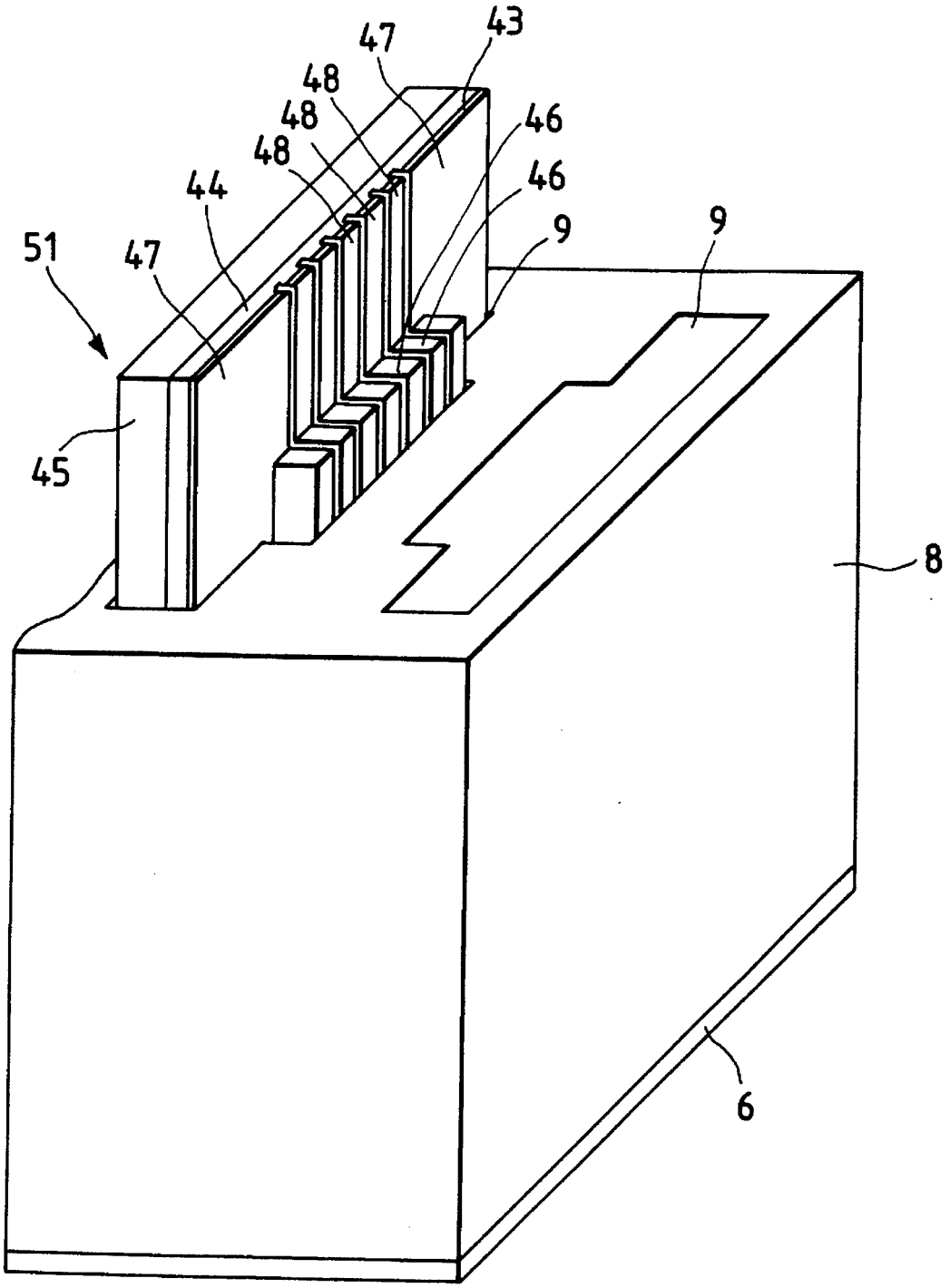
FIG. 5 illustrates the vibrator unit of the first preferred embodiment in a housing.
Figure 6:
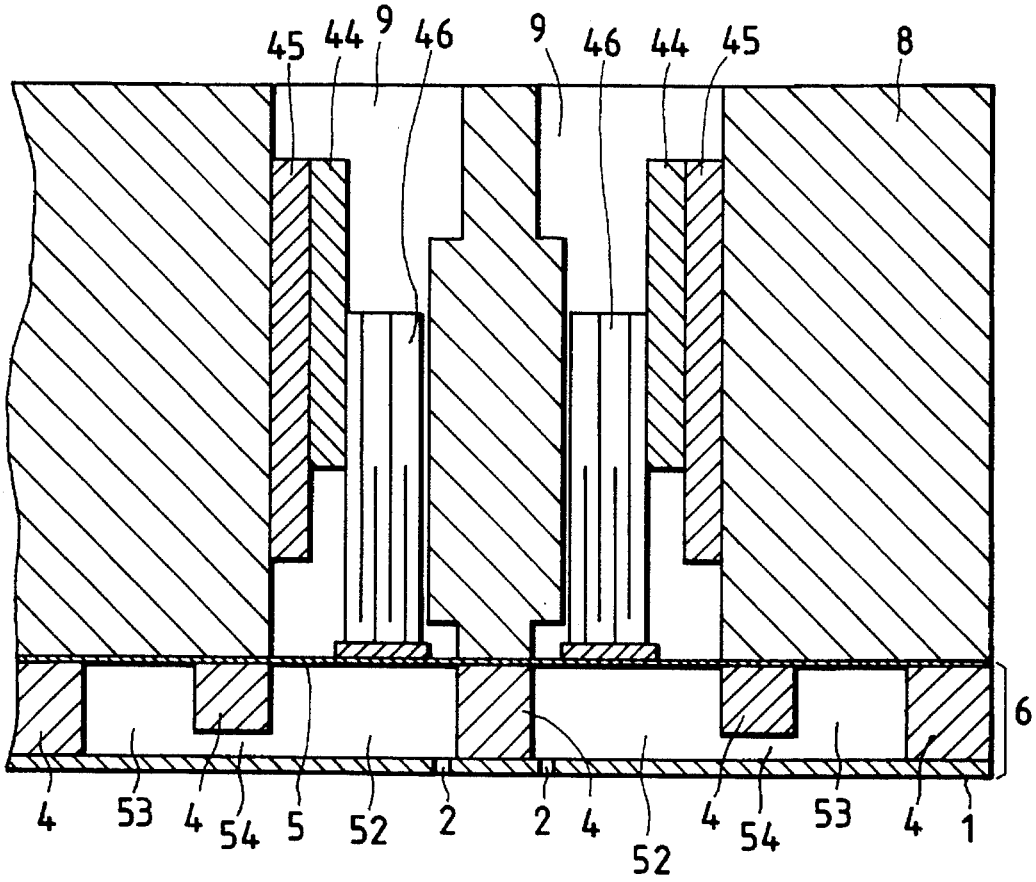
FIG. 6 illustrates the first preferred embodiment in detail.
Figure 7:
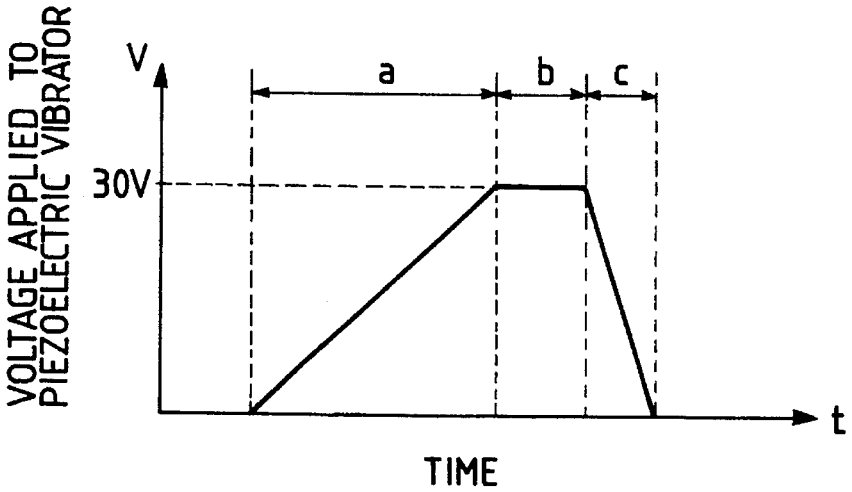
FIG. 7 illustrates a test signal applied to the piezoelectric vibrators.

When the piezoelectric vibrator unit 51 is dropped into a vibrator unit housing hole 9 of an outer case 8, having one end to which an ink flow route forming member 6 consisting of a nozzle plate, a spacer, and a vibration plate is attached, as shown in FIG. 5, the tips of the piezoelectric vibrators 46 abut the positions opposed to pressure generation chambers 52 formed in the flow route forming member 6 of the vibration plate 5, as shown in FIG. 6. In this state, when a print signal, of a trapezoidal wave for example, as shown in FIG. 7 is applied to the common electrode 47 and the drive electrode 48, the piezoelectric vibrator 46 is shrunk longitudinally on the rising edge of the print signal, thereby enlarging the pressure generation chamber 52 for causing ink to flow via an ink supply port 54 from a reservoir 53. When time period a has elapsed, the maximum voltage (in the embodiment, 30 V) is maintained for predetermined time period b. When the ink meniscus arrives at a predetermined position, the signal is made to fall over time period c. The piezoelectric vibrator 46 thus expands, thereby shrinking the pressure generation chamber 52 for ejecting an ink drop through a nozzle opening 2. By repeating these steps, dots can be formed conforming to print data.

When the piezoelectric vibrator 46 is expanded or shrunk, particularly to eject an ink drop, it is subjected to a large reaction force caused by a pressure load of the pressure generation chamber 52. However, it can sufficiently resist the reaction force caused by the pressure load of the pressure generation chamber 52 because the base 45 is made of a highly rigid material and is fixed to vibrator support plate 44 and further the front end 45*a* of the base 45 projects by a distance Δ L beyond the front end 44*a* of the vibrator support plate 44 (see FIG. 2).

Figure 8A:
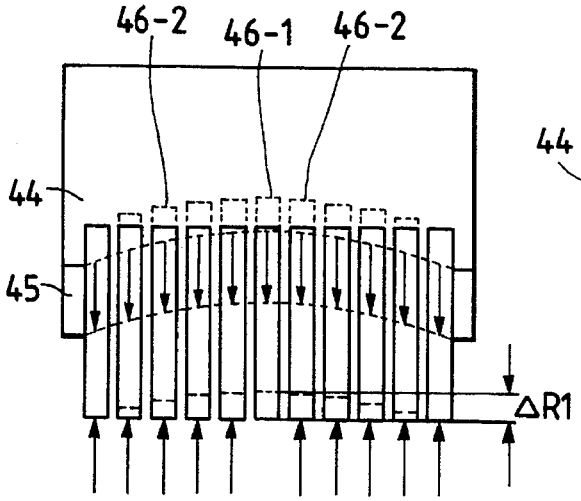
FIGS. 8(*a*) and 8(*b*) illustrate displacement of the piezoelectric vibrators in the invention and in a conventional device respectively.
Figure 8B:
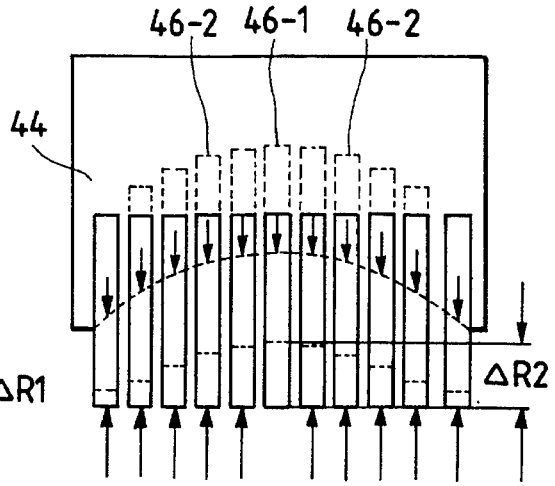

When a 30-volt drive signal was applied to all piezoelectric vibrators 46-2, 46-2, 46-2 . . . except a piezoelectric vibrator 46-1 located at the center of the piezoelectric vibrator support plate 44 for displacing them 1.75 μm for ejecting ink drops and then displacement amount ΔR1 of the piezoelectric vibrator 46-1, to which the drive signal was not applied, caused by propagation of the piezoelectric vibrators 46-2, 46-2, 46-2 . . . through the vibrator support plate 44 was measured with a displacement meter, as shown in FIG. 8(*a*), the measured displacement was about 0.3 μm. In contrast, as shown in FIG. 8(*b*), when the piezoelectric vibrator was supported by the piezoelectric vibrator support plate 44 only and assembled in the outer case 8 without attaching the base 45, the corresponding displacement amount ΔR2 was 0.45 μm, which was 1.5 times or more the value in the example according to the preferred embodiment of the invention.

Figure 9:
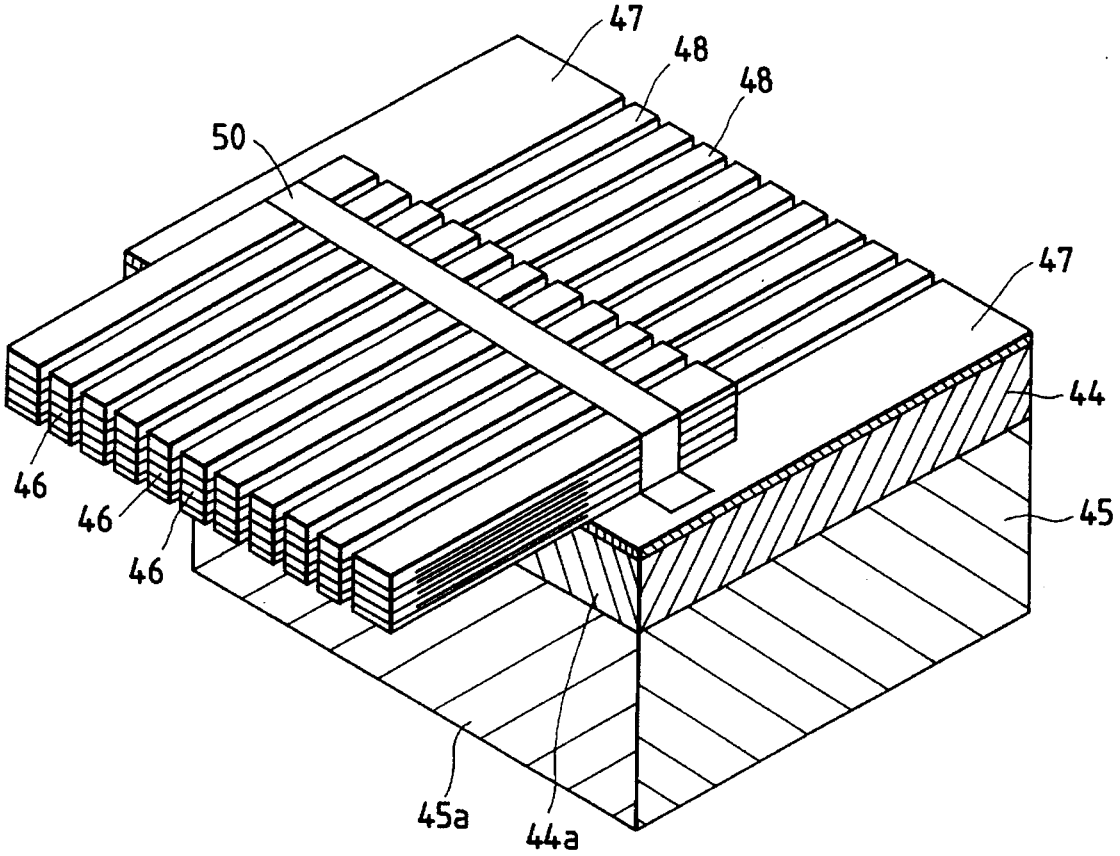
FIG. 9 illustrates a comparative example.
Figure 10:
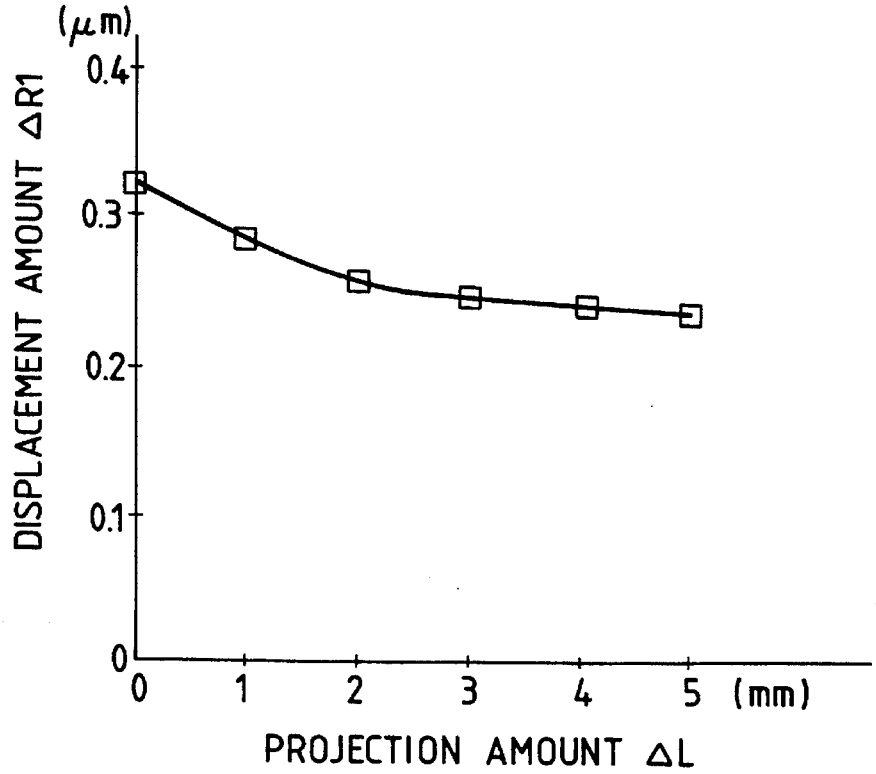
FIG. 10 is a graph of displacement versus projection length of the base.

A base 45 made of stainless steel having a given thickness, for example, 1.5 mm was used and, as shown in FIG. 9, a unit having the front end face 45*a* of the base 45 which does not extend beyond the front end face 44*a* of the piezoelectric vibrator support plate 44 was compared to a unit having the front end face 45*a* projecting from the front end face 44*a* of the piezoelectric vibrator support plate 44. The relationship between the projection amount ΔL and the displacement amount ΔR1 of the piezoelectric vibrator 46-1 to which the drive signal was not applied when a 30-volt drive signal was applied to all piezoelectric vibrators 46-2, 46-2, 46-2 . . . except the piezoelectric vibrator 46-1 located at the center of the piezoelectric vibrator support plate 44 for displacing them 1.75 μm was examined. As shown in FIG. 10, as the projection amount ΔL increases, the displacement amount ΔR1 decreases, but becomes substantially constant where the projection amount ΔL is 2 mm or more.

Figure 11:
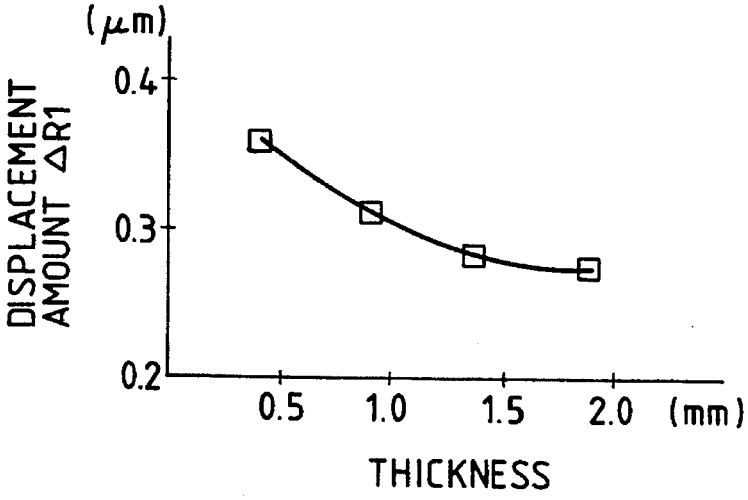
FIG. 11 is a graph of displacement amount versus thickness of the base.

Further, while the projection amount ΔL from the front end of the piezoelectric vibrator support plate of the base 45 was maintained constant, for example 3.9 mm, the thickness of the base 45 was varied and the displacement amount ΔR1 of the piezoelectric vibrator 46-1 to which the drive signal was not applied was examined as described above. As shown in FIG. 11, as the base 45 thickens, the displacement amount ΔR1 decreases, but becomes substantially constant where the thickness is 1.5 mm or more.

It was found from the test data that the base 45 made of highly rigid material provides an extremely effective device for preventing crosstalk or ink mist from occurring and that more effective means is provided by projecting the front face of the base 45 from the piezoelectric vibrator support plate 44 and thickening the base 45. Further, if the vibrator support plate 44 is thinned to about the piezoelectric vibrator disposition pitch, for example, about 0.15 mm, the displacement amount ΔR1 can be suppressed without hindering cutting of the piezoelectric vibration plate to the piezoelectric vibrators.

Figure 12B:
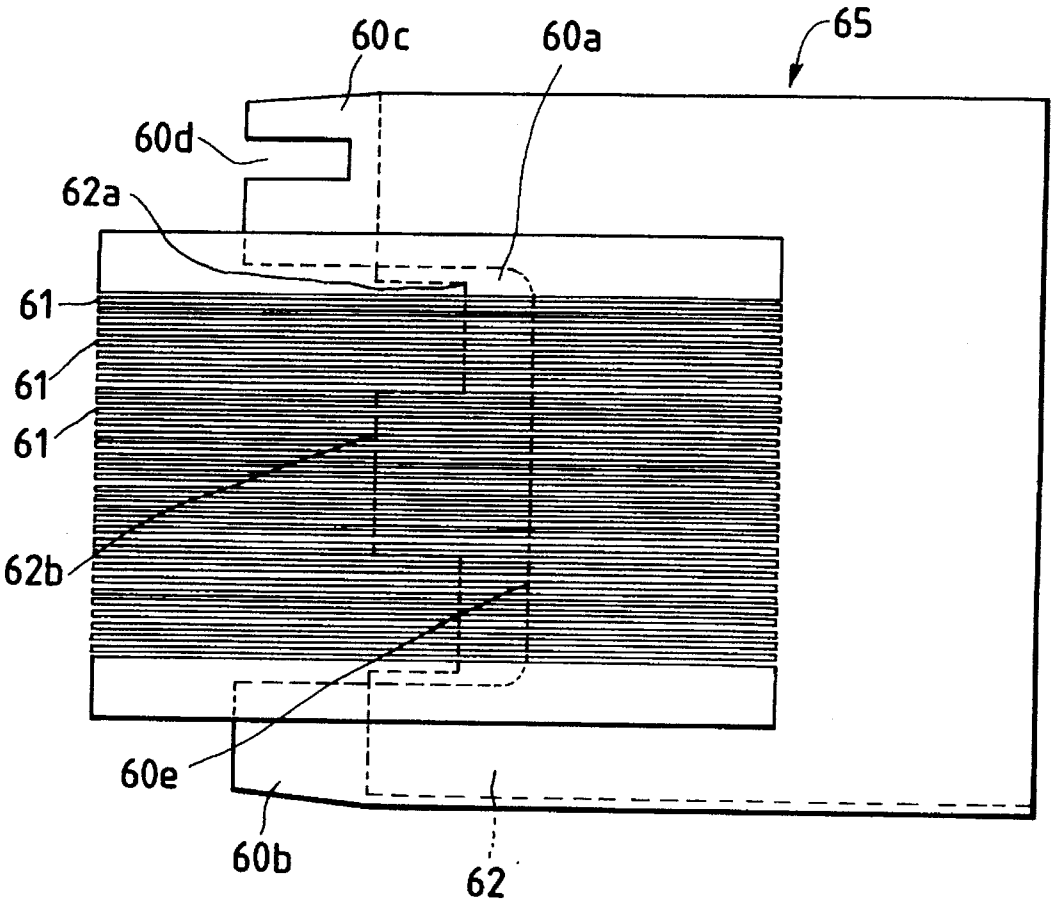
FIGS. 12(*a*) and 12(*b*) illustrate another preferred embodiment.
Figure 12A:
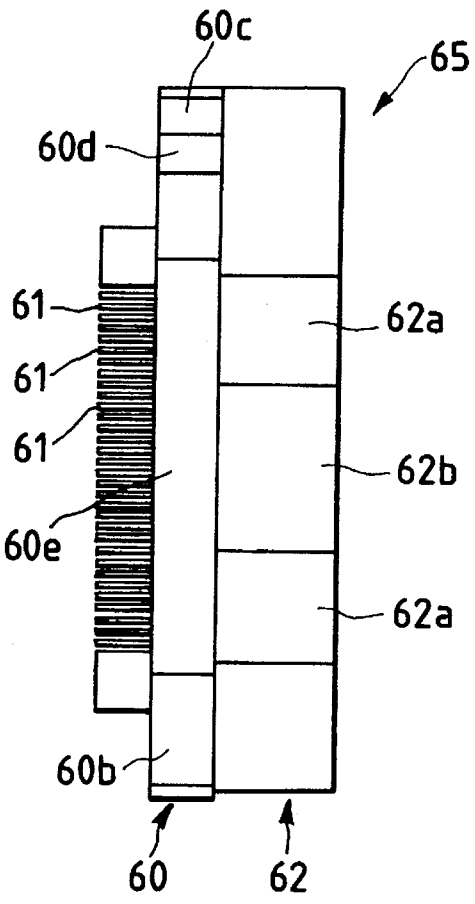

FIGS. 12(*a*) and 12(*b*) shows a second preferred embodiment of piezoelectric vibrator unit, wherein numeral 60 is a piezoelectric vibrator support plate made of a ceramic board having good cutting properties. The center portion is cut away to provide a recess 60*a* and projections 60*b* and 60*c* are formed on both sides of the support plate 60, one projection 60*c* having a positioning recess 60*d* formed therein. Piezoelectric vibrators 61, formed by cutting a piezoelectric vibration plate are fixed at a given pitch on the surface, as in the first embodiment.

Numeral 62 is a base. Front end face 62*a* of the portion thereof opposed to the piezoelectric vibrators 61, 61, 61 . . . projects toward the side of the piezoelectric vibrators 61 more than front end face 60e of the piezoelectric vibrator support plate 60, and a second projection 62*b* projects further towards the front end and is formed at the center of base 62. The base 62 is bonded to the piezoelectric vibrator support plate 60.

According to the second embodiment, if the relative position between the front face position of the piezoelectric vibrators 61, 61, 61 . . . is preset to a predetermined positional relationship, the recess 60*d* of the piezoelectric vibrator support plate 60 is positioned by engagement with a projection (not shown) of outer case 8 and the tip of each piezoelectric vibrator 61 abuts pressure generation chamber 52 at predetermined precision simply by dropping the vibrator unit 65 into a vibrator unit housing hole 9 of the outer case 8.

The base 62 made of highly rigid material projects toward the side of the piezoelectric vibrators 61 to a greater degree than the piezoelectric vibrator support plate 60 at least in the area opposed to the piezoelectric vibrators 61, and thus can resist reaction forces generated by ejection ink. Further, the second projection 62*b* is formed on the base 62 and reinforced selectively, thereby furthermore securely preventing ink mist or crosstalk from occurring while maintaining a device which is light in weight.

Figure 13:
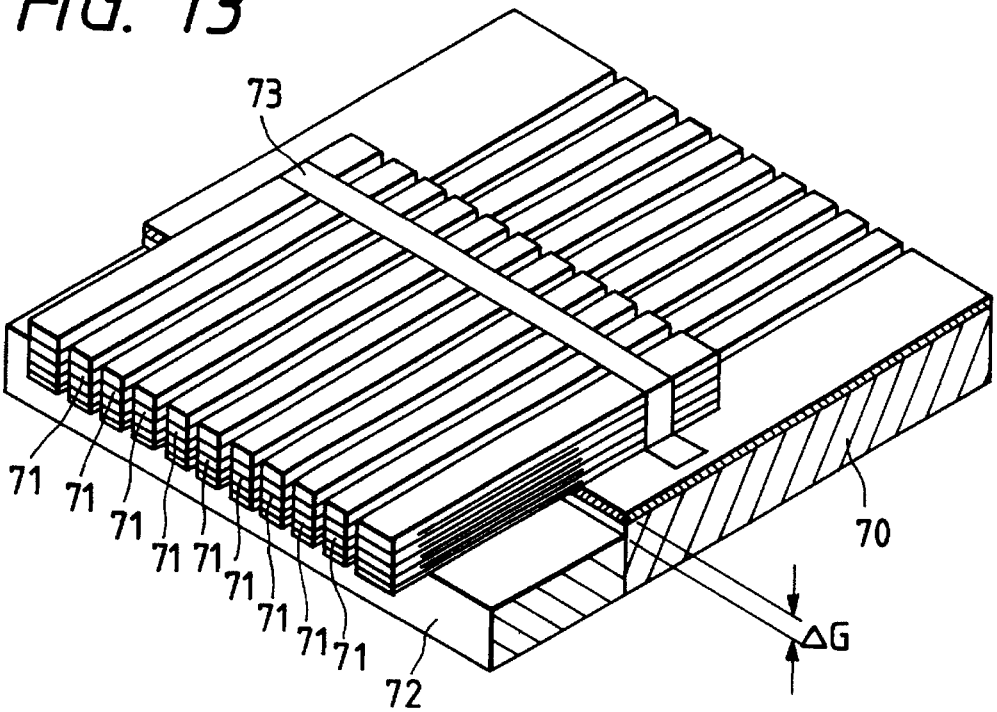
FIG. 13 illustrates another preferred embodiment.

FIG. 13 shows a third preferred embodiment of piezoelectric vibrator unit of ink jet recording head used with the invention. A piezoelectric vibrator support plate 70 is made comparatively thick with material having excellent cutting properties. A piezoelectric vibration plate is bonded to the surface of the piezoelectric vibrator support plate 70 and is cut to define piezoelectric vibrators 71 as described above. The base 72 is made of highly rigid material having thickness to provide a given gap ΔG between the base and the piezoelectric vibrators and is fixed to the front end of the piezoelectric vibrator support plate 70 with an adhesive. Numeral 73 indicates a junction electrode member.

In this embodiment, the piezoelectric vibrator support plate 70 in the area supporting the piezoelectric vibrator 71 receiving reaction force from a pressure generation chamber when an ink drop is spouted tends to be displaced, but distortion is suppressed to a minimum because of rigidity the base 72. This prevents ink mist or crosstalk from occurring through nozzle openings.

According to this embodiment, the base 72 made of material having a comparatively large density can be formed to a minimum size to prevent the piezoelectric vibrator support plate 70 from being distorted and maintain a light weight device. Even if the piezoelectric vibrator support plate 70 has a sufficient thickness fitted for cutting, the gap ΔG between the base 72 and the piezoelectric vibrators 71 can be set to the minimum for preventing ink mist or crosstalk from occurring.

Figure 14:
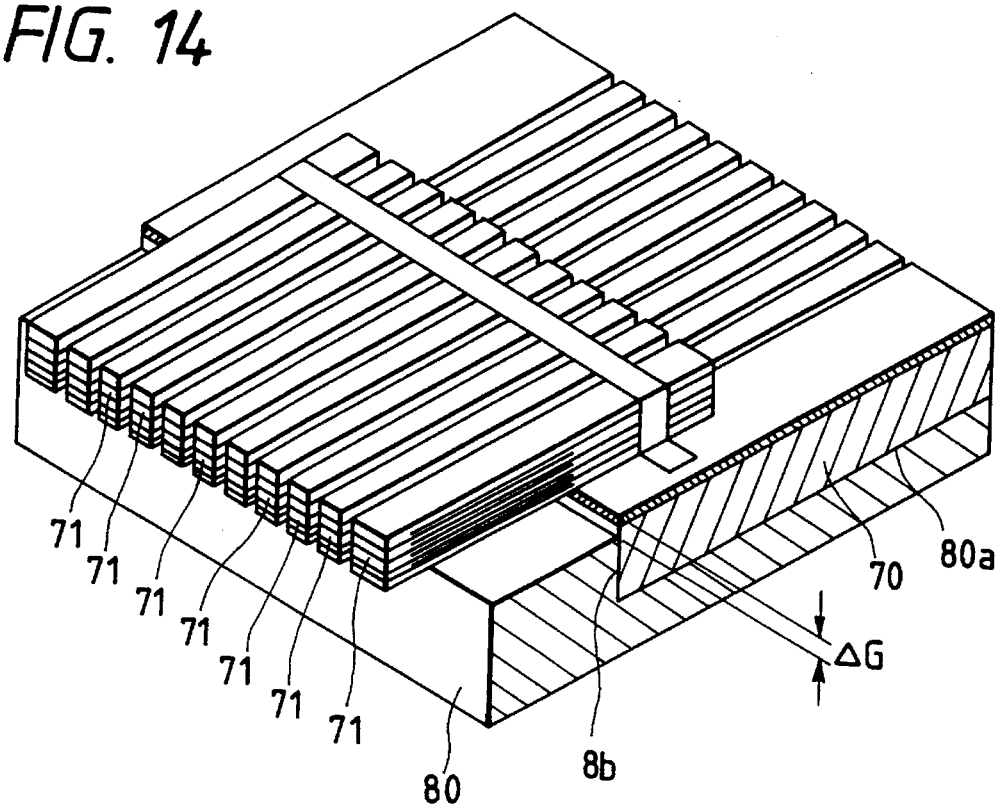
FIG. 14 illustrates another preferred embodiment.

In another preferred embodiment, the piezoelectric vibrators 71, 71 are supported only by the piezoelectric vibrator support plate 70. A base 80 formed with a stepped level difference portion 80*a* to provide a gap ΔG between the base and piezoelectric vibrators 71 on the rear side are used and the front of piezoelectric vibrator support plate 70 can be made to abut a vertical wall 80*b* of the level difference portion 80a for bonding, as shown in FIG. 14.

Figure 15A:
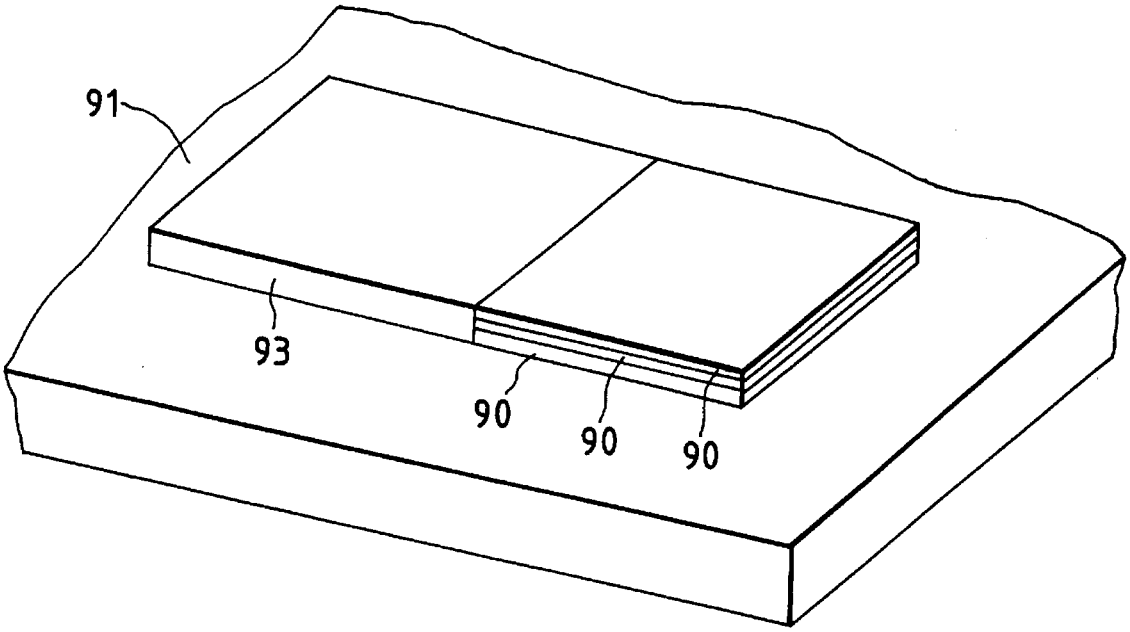
FIGS. 15(*a*) and 15(*b*) illustrates another assembly process of the device.
Figure 15B:
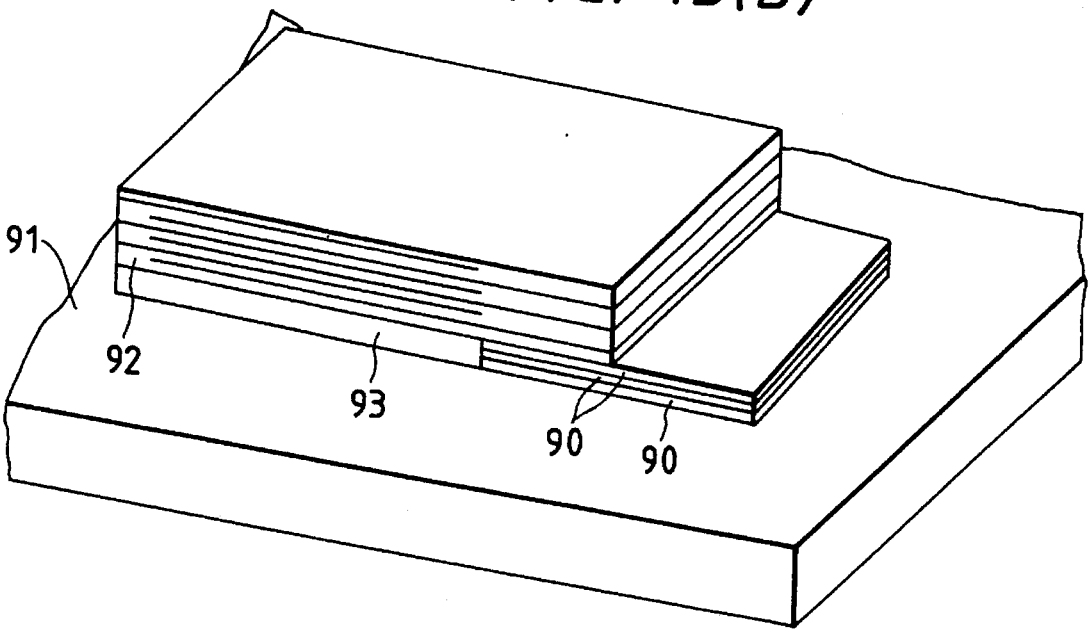

The piezoelectric vibration plate and the piezoelectric vibrator support plate are separate members in these embodiments. However, as shown in FIG. 15, as many layers of green sheets 90 of piezoelectric material as required are laminated on a substrate 91 so as to provide an appropriate thickness as a piezoelectric vibrator support plate after sintering (see FIG. 15(*a*)) and a piezoelectric vibration plate manufacturing process similar to that as shown in FIG. 3 may be repeated on the surface (see FIG. 15(*b*) to form a piezoelectric vibration plate 92. Numeral 93 is a temporary base used for filling the gap due to the level difference until completion of the sintering. According to this embodiment, bonding of the piezoelectric vibration plate and piezoelectric vibrator support plate is made unnecessary and rigidity can also be raised because there is no adhesive layer.

The above-identified embodiments relate to a recording head of a so-called "face eject" type provided by laminating the nozzle plate, spacer, and vibration plate as an example. However, a similar effect can be produced if the invention is applied to a spacer for forming a recording head of a so-called "edge eject" type with the substrate, spacer, and vibration plate laminated and nozzle openings pierced on the end face in the length direction of pressure generation chambers.

As described above, according to the invention, there is provided an ink jet recording head for ejecting ink drops by expanding or shrinking a pressure generation chamber of an ink flow route forming member consisting of nozzle openings, the pressure generation chamber, an ink supply port, and a reservoir. Piezoelectric vibrators are used in a vertical vibration mode. The piezoelectric vibrators are disposed and fixed in a row with a predetermined pitch, to a piezoelectric vibrator support plate having excellent cutting properties and the piezoelectric vibrator support plate is fixed to a base made of a material having a larger rigidity than the support plate. Therefore, a cutting operation is not hindered and if the piezoelectric vibrator support plate is subjected to reaction force when ink is ejected, the base resists the force. Thus, undesired displacement of the contiguous piezoelectric vibrators can be suppressed to prevent ink mist or crosstalk from occurring and the outer case can be made of polymeric material having a low rigidity to allow a recording head to be light in weight.

It will be apparent to one skilled in the art that various modifications can be made to the disclosed embodiments without departing from the scope of the invention, as defined by the appended claims.

What is claimed is:

1. An ink jet recording head for ejecting ink drops by expanding or shrinking a pressure generation chamber of an ink flow route forming member with vibrators, said ink flow route forming member having nozzle openings, the pressure generation chamber, an ink supply port, and a reservoir formed therein, said ink jet recording head comprising:

a piezoelectric element which is divided into a plurality of piezoelectric vibrators by slits formed in said piezoelectric element, said piezoelectric vibrators having a longitudinal axis and vibrating in a vertical vibration mode and being disposed and fixed in a row with a predetermined pitch to a piezoelectric vibrator support plate, said support plate having a longitudinal axis and being formed of a material having a resistance to cutting by a cutter which is the same as a resistance to cutting of said piezoelectric vibrators and having grooves formed in a surface thereof which correspond to the slits formed in said piezoelectric element, said piezoelectric vibrators having a non-active end portion that is supported by the vibrator support plate and an active portion which is not supported by the vibrator support plate, said active portion being coupled to said ink flow route forming member; and a base having a longitudinal axis and being made of material having a rigidity which is higher than a rigidity of said support plate, said base being fixed to said support plate by an adhesive;

wherein said piezoelectric vibrators, said vibrator support plate and said base are laminated to one another so that said longitudinal axes are parallel to one another.

2. An ink jet recording head for ejecting ink drops by expanding or shrinking a pressure generation chamber of an ink flow route forming member with vibrators, said ink flow route forming member having nozzle openings, the pressure generation chamber, an ink supply port, and a reservoir formed therein, said ink jet recording head comprising:

a piezoelectric element which is divided into a plurality of piezoelectric vibrators by slits formed in said piezoelectric element, said piezoelectric vibrators having a longitudinal axis and vibrating in a vertical vibration mode and being disposed and fixed in a row with a predetermined pitch to a piezoelectric vibrator support plate, said support plate having a longitudinal axis and being formed of a material having a resistance to cutting by a cutter which is the same as a resistance to cutting of said piezoelectric vibrators and having grooves formed in a surface thereof which correspond to the slits formed in said piezoelectric element, said piezoelectric vibrators having a non-active end portion that is supported by the vibrator support plate and an active portion which is not supported by the vibrator support plate, said active portion being coupled to said ink flow route forming member; and a base having a longitudinal axis and being made of material having a rigidity which is higher than a rigidity of said support plate, said base being fixed to said support plate by an adhesive.

3. The ink jet recording head as claimed in any one of claims 1 or 2 wherein said base has a front end side and said support plate has a front end, said front end side of said base projects beyond said front end of said support plate.

4. The ink jet recording head as claimed in any one of claims 1 or 2 wherein said base projects over said support plate at a central area of the row of said piezoelectric vibrators.

5. The ink jet recording head as claimed in any one of claims 1 or 2 wherein said base has a stepped level difference portion and said support plate has a front end abutting a wall face defined by said level difference portion.

6. The ink jet recording head as claimed in any one of claims 1 or 2 wherein said support plate is made of one of glass and a piezoelectric material.

7. The ink jet recording head as claimed in any one of claims 1 or 2 wherein said support plate is sintered integrally with said piezoelectric vibrators.

8. The ink jet recording head of any one of claims 1 or 2, wherein said ink flow route forming member comprises a vibration plate and wherein said vibrators, said support plate, and said base are assembled into one unit, and said piezoelectric vibrators (7) have free ends and are mounted in an outer case (8) for supporting said route forming member (6), said free ends abutting against said vibration plate (5) of said ink flow route forming member (6).

9. An ink jet recording head for ejecting ink drops by expanding or shrinking a pressure generation chamber of an ink flow route forming member with vibrators, said ink flow route forming member having nozzle openings, the pressure generation chamber, an ink supply port, and a reservoir formed therein, said ink jet recording head comprising:

piezoelectric vibrators, said vibrators vibrating in a vertical vibration mode, disposed and fixed in a row with a predetermined pitch to a piezoelectric vibrator support plate, said support plate is formed of a material having a resistance to cutting by a cutter which is the same as a resistance to cutting of said piezoelectric vibrators, said piezoelectric vibrators having one end portion that is supported by the vibrator support plate and a second end portion which is not supported by the vibrator support plate, said second end portion being coupled to said ink flow route forming member; and a base made of material having a rigidity which is higher than a rigidity of said support plate, said base being fixed to said support plate;

wherein said support plate has a front end and said base is fixed to said front end of said support plate.

10. An ink jet recording head for ejecting ink drops by expanding or shrinking a pressure generation chamber of an ink flow route forming member with vibrators, said ink flow route forming member having nozzle openings, the pressure generation chamber, an ink supply port, and a reservoir formed therein, said ink jet recording bead comprising:

piezoelectric vibrators, said vibrators vibrating in a vertical vibration mode, disposed and fixed in a row with a predetermined pitch to a piezoelectric vibrator support plate, said support plate is formed of a material having a resistance to cutting by a cutter which is the same as a resistance to cutting of said piezoelectric vibrators, said piezoelectric vibrators having one end portion that is supported by the vibrator support plate and a second end portion which is not supported by the vibrator support plate, said second end portion being coupled to said ink flow route forming member; and a base made of material having a rigidity which is higher than a rigidity of said support plate, said base being fixed to said support plate;

wherein said base is made of one of tool steel, stainless steel, soft iron, and zinc diecast material.

11. An ink jet recording head for ejecting ink drops by expanding or shrinking a pressure generation chamber of an ink flow route forming member with vibrators, said ink flow route forming member having nozzle openings, the pressure generation chamber, an ink supply port, and a reservoir formed therein, said ink jet recording head comprising:

piezoelectric vibrators, said vibrators vibrating in a vertical vibration mode, disposed and fixed in a row with a predetermined pitch to a piezoelectric vibrator support plate, said support plate is formed of a material having a resistance to cutting by a cutter which is the same as a resistance to cutting of said piezoelectric vibrators, said piezoelectric vibrators having one end portion that is supported by the vibrator support plate and a second end portion which is not supported by the vibrator support plate, said second end portion being coupled to said ink flow route forming member; and a base made of material having a rigidity which is higher than a rigidity of said support plate, said base being fixed to said support plate;

wherein said support plate is formed by laminating piezoelectric materials and sintering the piezoelectric materials.

12. An ink jet recording head comprising:

a vibrator support plate, having a cutaway portion formed at one end thereof to define a recess and two projections on said vibrator support plate;

a plurality of piezoelectric vibrators, said vibrators vibrating in a vertical vibration mode, and fixed in a row at a predetermined pitch to said vibrator support plate, said piezoelectric vibrators having ends which are free and extend off of said vibrator support plate;

a base, said vibrator support plate being fixed to said base, said base having an edge which extends into said recess in a direction towards said ends of said piezoelectric vibrators, said edge having at least one projection formed thereon, said base having a rigidity which is higher than a rigidity of said vibrator support plate; and an ink flow route forming member having an ink reservoir an ink supply port, and a pressure generation chamber formed therein, said ends of said piezoelectric vibrators being coupled to said ink flow route forming member.

13. An ink jet recording head comprising:

a vibrator support plate having a front surface;

a plurality of piezoelectric vibrators, in a vertical vibration mode, and fixed said vibrators vibrating in a row at a predetermined pitch to said vibrator support plate on a surface of said vibrator support plate which is transverse to said front surface, said piezoelectric vibrators having ends which are free and extend beyond said front surface said vibrator support plate;

a base fixed to said front surface, said base having a thickness which is less than a thickness of said vibrator support plate, said base having a rigidity which is higher than a rigidity of said vibrator support plate; and an ink flow route forming member having an ink reservoir an ink supply port, and a pressure generation chamber formed therein, said ends of said piezoelectric vibrators being coupled to said ink flow route forming member.

14. An ink jet recording head comprising:

a vibrator support plate having a front surface;

a plurality of piezoelectric vibrators, in a vertical vibration mode, and fixed in a row at a predetermined pitch to said vibrator support plate on a surface of said vibrator support plate which is transverse to said front surface, said piezoelectric vibrators having ends which are free and extend beyond said front surface of said vibrator support plate;

a base, said base having a stepped portion formed therein to lo define to portions of different thickness in said base and a wall extending between the two portions, said wall being fixed to said front surface of said vibrator support plate, said base having a rigidity which is higher than a rigidity of said vibrator support plate; and an ink flow route forming member having an ink reservoir an ink supply port, and a pressure generation chamber formed therein, said ends of said piezoelectric vibrators being coupled to said ink flow route forming member.

15. An ink jet recording head for ejecting ink drops by expanding or shrinking a pressure generation chamber of an ink flow route forming member with vibrators, said ink flow route forming member having nozzle openings, the pressure generation chamber, an ink supply port, and a reservoir formed therein, said ink jet recording head comprising:

piezoelectric vibrators, said vibrators vibrating in a vertical vibration mode, disposed and fixed in a row with a predetermined pitch to a piezoelectric vibrator support plate, said support plate is formed of a material having a resistance to cutting by a cutter which is the same as a resistance to cutting of said piezoelectric vibrators, said piezoelectric vibrators having one end portion that is supported by the vibrator support plate and a second end portion which is not supported by the vibrator support plate, said second end portion being coupled to said ink flow route forming member; and a base made of material having a rigidity which is higher than a rigidity of said support plate, said base being fixed to said support plate, wherein said base has a front end side and said support plate has a front end, and wherein said front end side of said base projects beyond said front end side of said support plate by at least 2 mm.

16. An ink jet recording head for ejecting ink drops by expanding or shrinking a pressure generation chamber of an ink flow route forming member with vibrators, said ink flow route forming member having nozzle openings, the pressure generation chamber, an ink supply port, and a reservoir formed therein, said ink jet recording head comprising:

piezoelectric vibrators, said vibrators vibrating in a vertical vibration mode, disposed and fixed in a row with a predetermined pitch to a piezoelectric vibrator support plate, said support plate is formed of a material having a resistance to cutting by a cutter which is the same as a resistance to cutting of said piezoelectric vibrators, said piezoelectric vibrators having one end portion that is supported by the vibrator support plate and a second end portion which is not supported by the vibrator support plate, said second end portion being coupled to said ink flow route forming member; and a base made of material having a rigidity which is higher than a rigidity of said support plate, said base being fixed to said support plate, wherein a thickness of said base is at least 1.5 mm thick.

* * * * *